United States Patent [19]

Beebe

[11] 4,154,340

[45] May 15, 1979

[54] COMBINATION RELOADING TRAY AND DIE BOX

[76] Inventor: Richard W. Beebe, P.O. Box 422, Dryden, N.Y. 13053

[21] Appl. No.: 877,174

[22] Filed: Feb. 13, 1978

[51] Int. Cl.[2] ..... B65D 85/38

[52] U.S. Cl. ..... 206/372; 206/305

[58] Field of Search ..... 206/372, 373, 379, 305

[56] References Cited

U.S. PATENT DOCUMENTS

| | | | |
|---|---|---|---|
| 405,613 | 6/1889 | Sperry | 206/379 |
| 769,616 | 9/1904 | Kraus | 206/379 |
| 3,235,062 | 2/1966 | Myers | 206/305 |
| 3,239,069 | 3/1966 | Hallins | 206/379 |
| 3,269,529 | 8/1966 | Hume | 206/373 |
| 3,499,525 | 3/1970 | Kanter | 206/379 |

FOREIGN PATENT DOCUMENTS

| | | | |
|---|---|---|---|
| 832430 | 2/1952 | Fed. Rep. of Germany | 206/379 |

*Primary Examiner*—Herbert F. Ross

*Attorney, Agent, or Firm*—Bruns & Jenney

[57] ABSTRACT

A combination reloading tray and die box for securely storing precision tools used in a process for reloading spent shells that includes a container having a hinged and latchable top cover. Shell receiving blind holes are recessed within the cover and the bottom wall of the container. A die support frame and shell holder mounting posts are located within the container which are arranged to coact with the end walls of the blind holes recessed in the cover and the bottom wall of the container so as to securely seat the dies and shell holders within the container when the cover is closed and latched.

4 Claims, 3 Drawing Figures

COMBINATION RELOADING TRAY AND DIE BOX

BACKGROUND OF THE INVENTION

This invention relates to apparatus for facilitating the reloading of firearm cartridges and, in particular, to a combination reloading tray and die box for safely and securely storing precision tools used in the reloading process.

When a cartridge having a brass shell casing is fired in a weapon and then ejected therefrom, the shell experiences certain stresses which cause the casing to become deformed. Prior to reusing the shell, it is customary to rework the casing in order to insure its operability and to provide for the safety of the user. Reworking of the spent shell is generally carried out in a series of separate steps or operations, each of which usually requires the use of a different die. As a consequence, the dies are normally supplied in sets with the number of dies in the set varying in regard to the type and caliber of cartridges involved. Typically, however, there will be either two or three dies to a set.

In practice, the shells are reloaded in a press having a stationary anvil and a movable ram. The dies are threaded into the anvil and secured in place by means of a locking nut that is arranged to engage the anvil. A shell holder is seated within the ram and is arranged to support a shell casing in axial alignment with the working centerline of the press with the open end of the casing facing the die. In operation, the ram brings the shell into operable relation with the die and applies sufficient pressure to carry out the intended resizing or bullet reseating operation. Shells that are being reworked are normally supported in an upright posture within a reloading tray; the shells being separated into segregated groups relating to the various reloading steps whereby they can be passed from one group to another as the steps are completed.

As can be seen, a number of pieces of equipment are required to reload cartridges. As a consequence, segregating and providing for the safety of some of these tools and, in particular, precision dies and shell holders, becomes a problem. Oftentimes, when these tools are not properly stored, they become contaminated with dirt, damaged through mishandling or even misplaced and eventually lost. Dirty and damaged tools can produce defective and potentially dangerous cartridges and lost tools are expensive to replace.

SUMMARY OF THE INVENTION

It is therefore an object of this invention to improve equipment used in the reloading of firearm cartridges.

A further object of this invention is to improve apparatus for storing precision tools used in the reloading process to prevent damage and loss thereof.

Another object of the present invention is to provide a combination reloading tray and storage box for housing precision tools used in the reloading process.

These and other objects of the present invention are attained by means of a container having a hinged and latched cover, a frame located in the container for holding a set of reloading dies therein, vertically aligned posts located in said container for supporting the shell holder thereon, said frame and said posts being arranged to coact with the cover to securely seat the dies and shell holder within the container when the cover is latched in a closed position, and the cover and the opposed bottom wall of the container having a plurality of blind circular holes recessed therein for slidably supporting the cartridges being reloaded whereby the container may be used as a reloading tray.

BRIEF DESCRIPTION OF THE DRAWINGS

For a better understanding of these and other objects of the present invention, reference is had to the following detailed description of the invention which is to be read in conjunction with the following drawings, wherein.

DETAILED DESCRIPTION OF THE INVENTION

Figure 1:
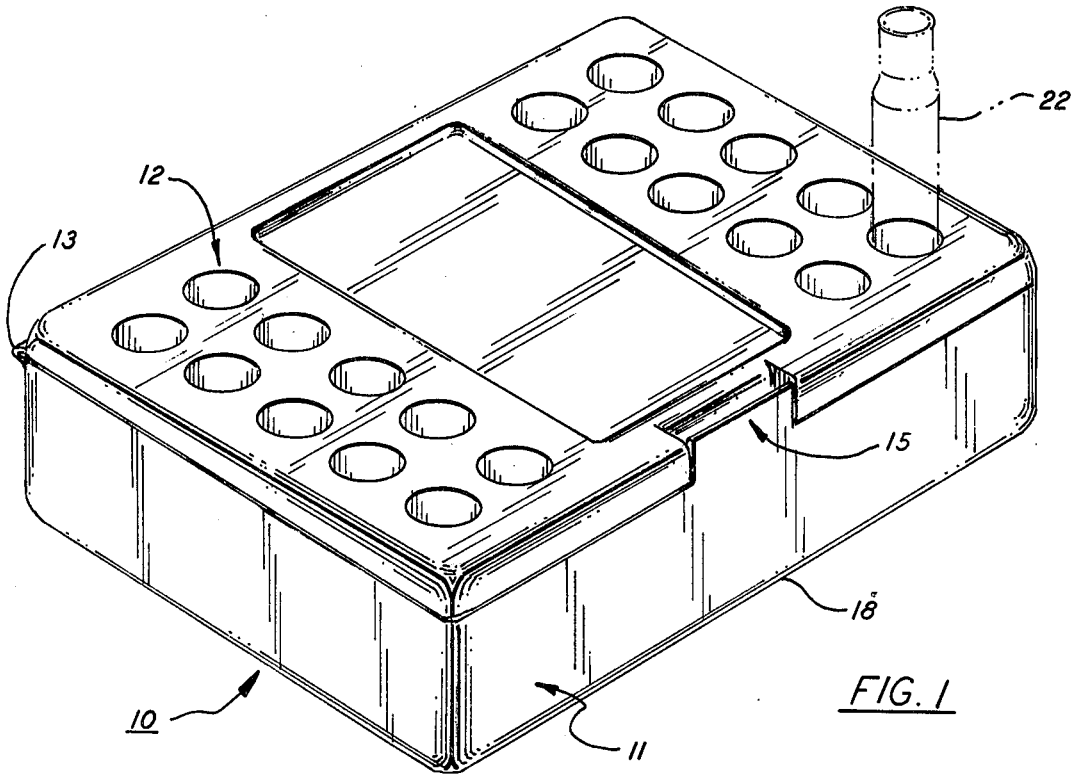
FIG. 1 is a perspective view of a container for supporting therein tools used in the reloading process and which embodies the teachings of the present invention.

Referring initially to FIG. 1, there is shown a combination reloading tray and die box, generally referenced an enclosed container 10, that consists of a rectangular body section 11 and a planar top cover 12. The cover, in assembly, is supported on the body via an elongated hinge 13 and is securable in a closed position by a latch mechanism 15. Although the container can be formed of any suitable material, it is preferred that the body, the cover, the hinge and the latch be injection molded into a single piece structure using a plastic material, such as polypropylene or the like, that exhibits high impact resisting properties.

Although the container may take any suitable shape, it is preferable that it be generally rectangular in form with the planar surfaces of the cover and the opposing bottom 18 being in parallel alignment. As seen in FIG. 1, two groups of circular blind holes 20 are recessed into the top cover. A similar grouping of blind holes 21 (FIG. 3) are also recessed in the bottom wall of the container. The holes are adapted to slidably receive therein a number of shells that are being reloaded. As shown in phantom outline in FIG. 1, the shells 22 are generally supported in an upright position when the closed container is resting on a flat surface such as a workbench or the like. In practice, the diameter of the holes formed in the cover are of a different size than those formed in the bottom wall of the container. As a result, shells of different caliber cartridges may be accommodated by simply turning the container over. As can be seen, the container can thus be employed as a reloading tray for temporarily holding shells during the reloading process. By separating the holes into rows and groups of rows, the shells can be conveniently segregated as to the various steps involved in the process.

Figure 3:
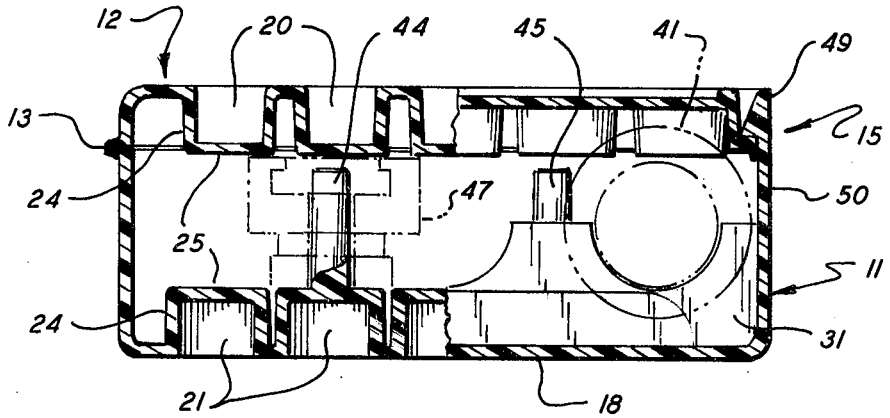
FIG. 3 is a sectional end view of the container shown in FIG. 2 that is taken along lines 3—3 in FIG. 2 further showing the cover in a closed and latched position.
Figure 2:
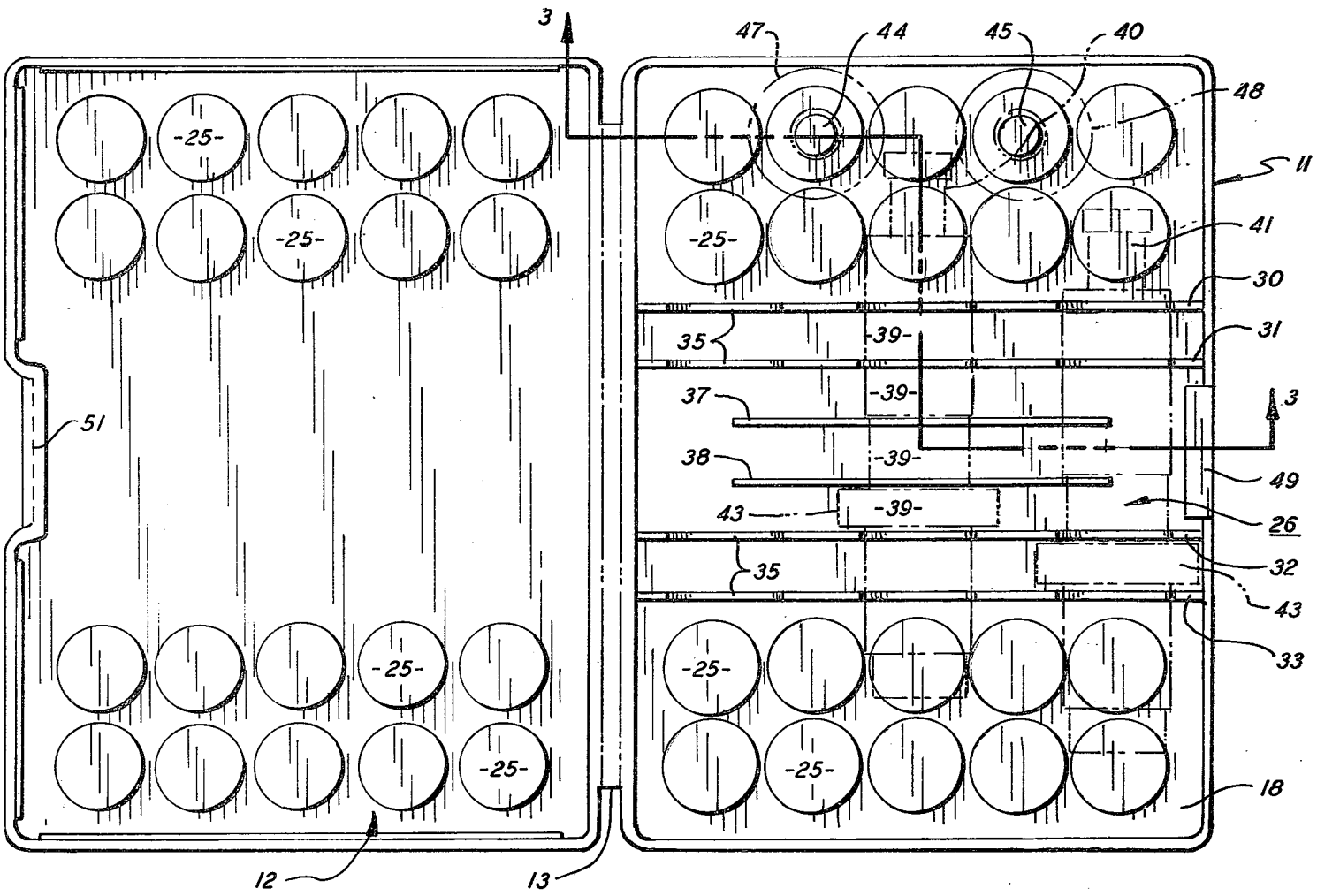
FIG. 2 is an enlarged top plan view of the container shown in FIG. 1 with its cover opened to further illustrate the interior structure thereof.

Referring now more specifically to FIGS. 2 and 3, the blind holes formed in the top cover and the bottom wall of the container are each contained in a circular cylinder 24 which terminates in a flat end wall 25. In assembly each of the cylinders depending inwardly from the cover are brought to a common depth as are those depending upwardly from the bottom wall 18. Accordingly, the end walls associated with each element combine to describe a plane that is generally parallel with the plane of the wall to which they depend. As will be described in further detail below, the faces of the end walls play an important function in the operation of the present invention for securing tools seated in the container in place when the cover is latched in a closed position.

A die supporting frame 26 is cast or molded inside the body section of the container upon which a set of reloading dies may be seated. In this embodiment of the invention, the frame comprises four parallel walls 30–33 that rise vertically from the bottom wall of the container and extend transversely across the width of the body section. Each wall contains three semicircular grooves 35 formed therein which cooperate to create three longitudinal saddles for receiving a set of reloading dies thereon. The frame walls are set off in spaced apart pairs with walls 30 and 31 making up an upper pair and walls 32 and 33 making up a lower pair. Two transverse ribs 37,38 also rise from the bottom wall of the container to a slightly lower elevation than that of the frame wall and are equally spaced between the upper and lower frame pairs. As best seen in FIG. 2, the frame walls and the ribs separate the middle portion of the container into a series of laterally extended compartments 39 of substantially equal width.

As previously noted, a number of different dies are usually needed to rework a spent shell casing with the required dies making up a set. Typically, the body diameter of each die in a set is generally the same so that the dies can be interchangeably received in the anvil of the press. However, depending upon the operation performed and the type or caliber of the cartridge being worked, the length of the die and thus the general location of the locking ring will vary. As illustrated in FIG. 2, two dies 40,41 of different lengths are shown seated in the frame in phantom outline. As can be seen, the width of the lateral compartments 39 is such that the radially extending locking rings 43 can be conviently received therein and thus prevent the dies from sliding axially within the saddle. The plurality of the compartment thus provides the present container with the ability to accept dies of different configurations while at the same time permitting the dies to be securely seated upon the contoured saddles.

A pair of vertical posts 44 and 45 are molded into the interior body section of the container and depend upwardly from the surface of two cylinders associated with the blind holes formed in the bottom wall of the container. The posts are adapted to slidably receive thereon the ring-like shell holder 47,48 which are shown in phantom outline, that are employed in supporting cartridge shells in the movable ram of the reloading press.

As best seen in FIG. 3, the end walls associated with the blind holes formed in the bottom of the container are brought to an elevation that is equal to the lowest depth of the semicircular saddles formed in the frame. As a result, dies seated in the frame will bottom in arrested contact against the end walls thus providing a positive support to these precision tools. By the same token, the end walls associated with the blind holes recessed in the cover are also brought to a predetermined depth so that the end walls reside in close proximity with the outer periphery of the dies mounted in the frame when the cover is closed and latched. It should also be noted that the upper end walls also come in close proximity with the terminal ends of the posts when the cover is closed. It should be evident that by this arrangement both the dies and the shell holders mounted within the container are safely and securely stored in a well seated condition when the container is closed and latched. It should also be evident from the disclosure above that the container itself may be utilized as a reloading tray for accommodating therein the in process shells.

Referring once again to FIG. 3, the latch as well as the hinge are molded of plastic to provide "living" elements capable of being recycled innumerable times without breaking. The latch consists of a clasp 49 molded into the side wall 50 of the body section and which depends upwardly therefrom. The clasp is arranged to pass over a rib 51 formed in the cover to hold the cover tightly closed against the body section when the latch is secured. To open the container, the clasp is simply moved back thus allowing the living hinge to pull the cover toward an open condition.

While this invention has been described in reference to the disclosure herein set forth it is not necessarily limited to this particular embodiment and this application is intended to cover any modifications or changes as may come within the scope of the present invention.

I claim:

1. A combination reloading tray and container for storing a set of elongated reloading dies having radically extended locking nuts mounted thereon, the combination including a container having a body section consisting of a flat bottom wall and upwardly raised side walls depending from the bottom wall, and a removable cover having a planar top surface, the cover being mounted upon the body for enclosing the container, a plurality of laterally extended ribs located in the body section of the container to form compartments therebetween that are capable of slidably receiving the radial extended locking nuts of the dies in a set, a series of longitudinally extended contoured saddles formed in said ribs for supporting the elongated dies of a set in parallel alignment within the body of the container and whereupon the locking nuts of said dies are received in the compartments when the dies are seated upon the saddles, and said cover having a plurality of blind holes formed therein that are normal to the top surface of the cover and which pass downwardly from the top surface an equal distance so that the end walls of said blind holes are aligned to coplanar relationship at a depth such that the end walls retain the dies in a seated position upon said saddles when the cover is closed upon the body section and whereby shell cartridges to be reloaded are slidably supportable in an upright position within said holes said bottom wall of the body section includes a plurality of blind holes that are extended upwardly to an equal distance so that endwalls thereof are in coplanar alignment with the bottom surface of the contoured saddles.

2. The combination of claim 1 which further includes a hinge for rotatably supporting the cover upon the body section, and a latch that is operable for securing the cover in a closed condition against the body section.

3. The container of claim 1 that further includes one or more vertical posts depending upwardly from the bottom wall of the body section a predetermined distance such that the terminal ends of said one or more posts are positioned in close proximity with one of the end walls of the blind holes when the cover is in a closed condition whereby ring-like shell holders mounted on said posts are retained thereon when the cover is closed.

4. The combination of claim 1 wherein the blind holes formed in the cover and the body section are organized into groups with the holes in each group being of a different size than the holes of another group.

* * * * *